United States Patent [19]

Smith

[11] 4,155,551

[45] May 22, 1979

[54] NUNCHAKU DEVICE

[76] Inventor: David J. Smith, 401 Heacock Rd., Harbor Springs, Mich. 49740

[21] Appl. No.: 815,572

[22] Filed: Jul. 14, 1977

[51] Int. Cl.[2] ..... F41B 15/02

[52] U.S. Cl. ..... 273/84 R

[58] Field of Search ..... 273/80 R, 80 D, 81.2, 273/84 R; 272/75; 135/15 PQ, 69, 74, 75; 280/11.37 F, 11.37 L

[56] References Cited

U.S. PATENT DOCUMENTS

| | | | |
|---|---|---|---|
| 83,228 | 10/1868 | Warne | 273/84 R |
| 1,094,226 | 4/1914 | LeDuc | 273/84 R |
| 1,909,932 | 5/1933 | Digel | 273/84 R |
| 2,194,386 | 3/1940 | Dunaway | 273/84 R X |
| 3,323,796 | 6/1967 | Carlson | 273/84 R X |
| 3,448,748 | 6/1969 | Walrave | 135/15 PQ X |
| 3,635,233 | 1/1972 | Robertson | 135/15 PQ X |
| 3,730,544 | 5/1973 | Hyman | 135/15 PQ X |
| 3,937,468 | 2/1976 | Conde | 273/84 R |
| 4,070,023 | 1/1978 | Cutler | 273/84 R |

FOREIGN PATENT DOCUMENTS

| | | | |
|---|---|---|---|
| 1128243 | 8/1956 | France | 135/15 PQ |

*Primary Examiner*—Richard J. Apley

*Attorney, Agent, or Firm*—Basile and Weintraub

[57] ABSTRACT

A nunchaku device comprising an elongated tubular handle member having one open end which telescopically receives one end of a second solid handle member. The telescopic ends of the two handles are connected by a cord which carries an intermediate section, slidable along the interior of the first tubular member, and movable from an inward location in the interior of the first handle member to a position adjacent the opened end of the first handle so as to provide a means for centering the cord with respect to the periphery of the handle. Detent means carried by the second handle are engageable at selected locations along the length of the first handle so as to permit the second handle to lockingly engage the first handle at said selected positions.

2 Claims, 6 Drawing Figures

NUNCHAKU DEVICE

BACKGROUND OF THE INVENTION

I. Field of the Invention

The present invention relates generally to nunchaku devices and, in particular, to an improved construction of such nunchaku devices, wherein the device includes telescopic sections, and to a manner of making the improved device.

II. Description of the Prior Art

A nunchaku is an ancient martial arts weapon originally developed in Okinawa. Nunchakus are used today by many practitioners of martial arts, such as karate and the like. The nunchakus which are used today are generally made of two rod-like elements or handle members which are interconnected by either a cord or by a chain. Each of the elements is conventionally made of hard wood, such as rock maple, and usually has an overall length of 12 to 14 inches and a diameter of 1 to $1\frac{3}{4}$ inches. It has been proposed to make the elements of nunchakus of materials other than wood, and reference is made in U.S. Pat. No. 3,937,468 to the making of such nunchaku devices wherein the elements are made entirely of high-density polypropylene. It has also been suggested therein that the nunchaku device have a chain which is principally formed of a high-density polypropylene.

Other prior art known to the applicant consists of U.S. Pat. No. 3,323,796, which discloses a jousting apparatus comprising two sticks connected to each other by a cord or connecting member wherein plastic elements are utilized at the interface between the cord and each of the sticks.

U.S. Pat. No. 1,909,932 discloses a weapon which includes a telescopic element.

III. Prior Art Statement

In the opinion of the applicant, the aforementioned prior art includes the closest prior art of which the applicant is aware.

SUMMARY OF THE INVENTION

The present invention, which will be described subsequently in greater detail, comprises a nunchaku device having a pair of tubular handles interconnected by means of a cord with one of the tubular members having the cord end thereof being telescopically receivable in the other tubular member such that the one tubular member may be completely telescopically received by the other to a closed position and moved therefrom to an intermediate position wherein substantially all of the one tubular member projects from the other tubular member. The one tubular member is movable to a third position wherein the two handles are separated from one another and attached to the cord.

It is a primary object of the present invention to provide a nunchaku device which has a pair of telescopically engaging handles such that the handles form a compact, easily carried and easily concealable device.

It is a further object of the present invention to provide a nunchaku device which may be easily converted in one of its modes to a night stick for police use.

It is a further object of the present invention to provide a nunchaku device of the type described which is simple in its construction and design and, thus, easy to manufacture and maintain.

Other objects, advantages and applications of the present invention will become apparent to those skilled in the art of manufacturing nunchaku devices when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 2:
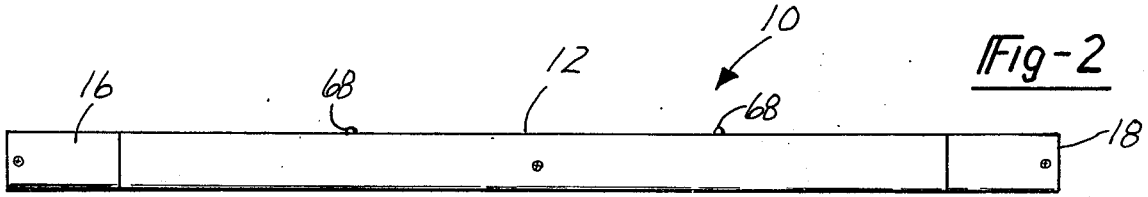
FIG. 2 is a front plan view of the nunchaku device illustrated in FIG. 1 with the nunchaku device being illustrated in a closed position.
Figure 3:
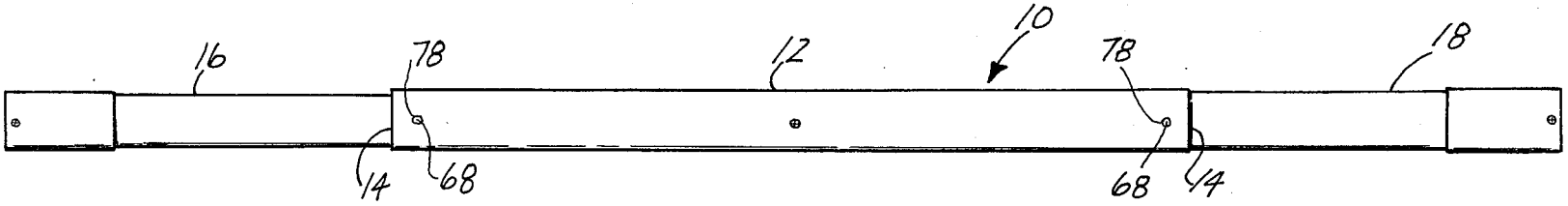
FIG. 3 is a front plan view of the nunchaku device illustrated in FIGS. 1 and 2 with the nunchaku device being illustrated in an intermediate position.
Figure 1:
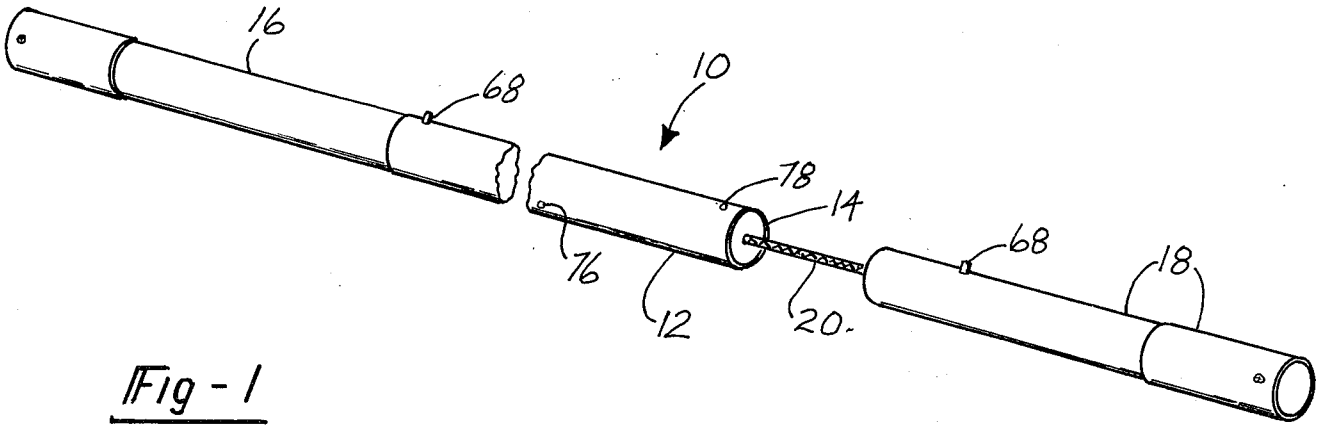
FIG. 1 is a perspective view of one example of a nunchaku device manufactured in accordance with the principles of the present invention and illustrated with portions thereof in a telescopic condition.

Referring now to the drawings and, in particular, to FIGS. 1 through 3 wherein there is illustrated one example of the present invention in the form of a nunchaku device 10. The device 10 comprises an intermediate or handle portion 12 which has an opening 14 at each end and which ends 14 telescopically receive handles 16 and 18 in a manner and for a purpose which will be described in detail hereinafter. As can best be seen in FIGS. 1 through 3, the nunchaku device 10 has four modes of operation. The first mode of operation is illustrated in FIG. 2 of the drawings wherein the handles 16 and 18 are both telescopically received and fully engaged within the ends 14 of the intermediate section 12. As will be described hereinafter, suitable detent means are provided to lockingly secure the handles 16 or 18 in the position illustrated.

FIG. 3 illustrates an intermediate extension of the nunchaku device 10 wherein the handles 16 and 18 are extended outwardly from the ends 14 of the intermediate section 12 so as to lengthen the overall length of the device 10 and create a shaft, which may be utilized as a weapon. Again, as will be described hereinafter, suitable detent means are provided for lockingly securing the handles 16 and 18 in the position illustrated in FIG. 3.

FIG. 1 illustrates the handle 18 as being fully extended from the intermediate section 12 but remains connected to the intermediate section by means of a cord 20. The handle 16 is illustrated as being fully inserted within the opposite end of the intermediate section 12. It can be realized that the handle 16 may also be fully extended and separated from the intermediate section 12 such that the nunchaku handles 16 or 18 are usable in the conventional manner on opposite ends of the intermediate section 12.

Figure 4:
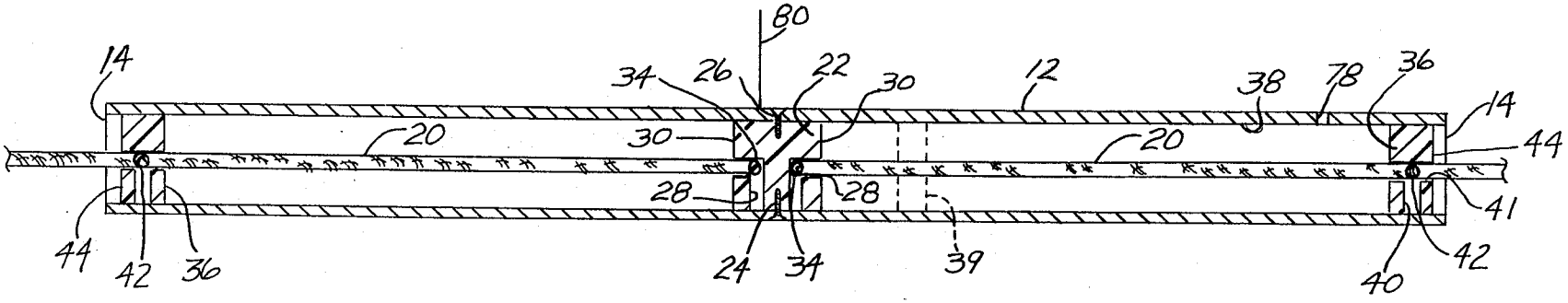
FIG. 4 is a longitudinal, cross-sectional view of the intermediate portion of the nunchaku device illustrated in FIGS. 1 through 3 of the drawings.
Figure 5:
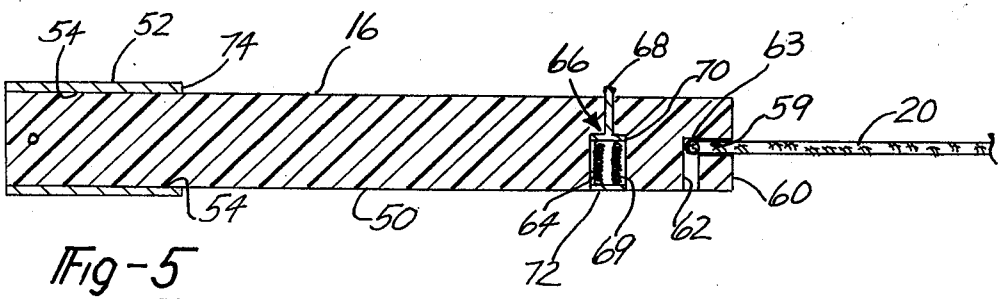
FIG. 5 is a longitudinal, cross-sectional view of the left end portion of the nunchaku device illustrated in FIGS. 1 through 3 of the drawings.
Figure 6:
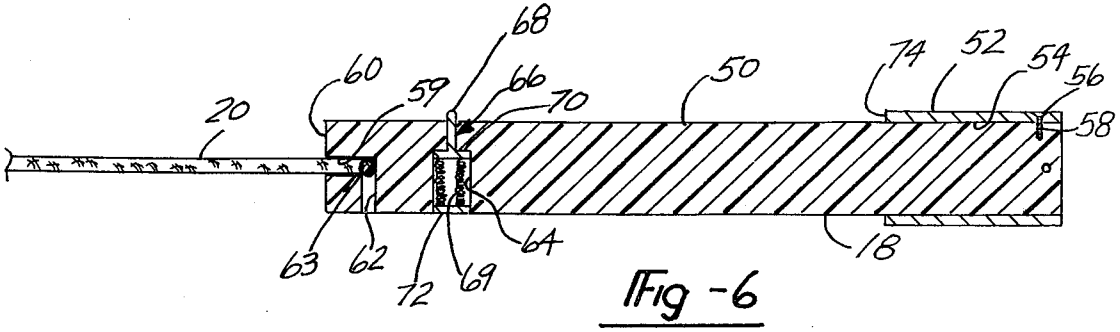
FIG. 6 is a longitudinal, cross-sectional view of the right-hand portion of the nunchaku device illustrated in FIGS. 1 through 3 of the drawings.

Referring now to FIGS. 4, 5 and 6 for a more detailed description of the manner in which the subject invention is fabricated, it will be seen that the intermediate section 12 is fabricated from a metal material and has a tubular configuration; however, it should be understood that other configurations, such as square configurations, may be employed in practicing applicant's invention. The central or mid-section of the intermediate section 12 has a cylindrically shaped anchor 22 which is secured to the mid-portion of the intermediate section 12 by any suitable means, such as threaded fasteners 24, which extend through tampered bores 26 in the intermediate section 12 and into threaded engagement with the anchor 22. On either side of the anchor 22 the intermediate section 12, its interior components, and the left- and right-end handles 16 or 18 are identical; and, thus, only the right-hand portion of the intermediate section 12 and the handle 18 associated therewith shall be described in detail hereinafter. However, it should be understood that the description of one handle 18 is applicable to the description of the handle 16, and like components are designated by the same number.

Still referring to FIG. 4, it can be seen that the left- and right-hand sides of the anchor 22 are provided with L-shaped bores 28 which extend from the center of the outer face 30 on opposite sides of the anchor 22 inwardly into the anchor approximately ¼ its width and then radially outwardly to the outer periphery of the cylindrically shaped anchor 22. This permits the nylon cord 20 to be knotted as at 34 such that the nylon cord 20 will extend from the surface 30 of the anchor 22 at the center point thereof and outwardly through the end 14 of the intermediate section 12 for connection to the handle 18 in a manner which will be described hereinafter. The intermediate section 12 further comprises a guide 36 which is of a cylindrical shape and is slidably mounted along the interior surface 38 of the intermediate section 12 from a position adjacent the end 14, as viewed in FIG. 4, at its outermost point of travel to a position indicated by the phantom lines at 39 nearing the surface 30 of the anchor 32 when the guide 36 has traveled to its innermost position. The guide 36 has an axial bore 41 which is intersected by a radial bore 40. These two bores permit the nylon cord 20 to extend axially through the guide 36 and outwardly therefrom for connection to the handle member 18, while the radial bore 40 permits a section 42 of the cord 20 to be knotted, as shown. Knotting the cord 20 at 42 fixes the location of the guide 36 at a predetermined location along the length of the cord 20. Of particular interest is the fact that the cord 20 emerges from the face 44 of the guide 36 at its center, thereby centrally locating the cord 20 with respect to the intermediate section 12. Both the anchor 22 and the cylindrically shaped guide 36 are preferably made from a hard nylon material; however, it is obvious that other materials may be employed in the manufacture of the aforementioned components.

Referring now to FIGS. 5 and 6, it can be seen that the handle members 16 and 18 are identical; and thus the description of the handle 18 shall be taken as being applicable to the description of the handle 16, as aforementioned. The handle 18 comprises an elongated, cylindrically shaped member 50 which is similar to the anchor 22 and guide 36 in that the member 50 is preferably made from a hard, nylon material; however, other materials may be employed in the manufacture of the handles 16 and 18. the outer end of the handle member 18 has a cap 52 in the form of a metal covering which is of a cylindrical shape and includes a bore 54 which snuggly receives the outer end of the member 50. Suitable fastening means, such as screws 56, extending through bores 58 in the cover 52, engage the outer end of the member 50 and secure it to the cover 52. The inner end of the member 50 is provided with an axial bore 59 which extends from the outer surface 60 at its center, inwardly a selected distance, wherein it engages a radial bore 62. The radial bore 62 permits a knot 63 to be tied at the end of the cord 20 which extends through the axial bore 59. It can thus be seen that this simple arrangement permits a coupling of the left-hand end of the member 18 to the anchor 22 with the nylon cord 20 passing through the guide 36 and being movable therewith. Toward the left end of the handle member 50, a step bore 64 is provided within which is a detent mechanism 66 that includes a detent engaging end 68 slidably mounted in the step bore 64 and an enlarged spring engaging end 70 that is biased upwardly; that is, it is biased in such a manner that the detent engaging end 68 extends upwardly and outwardly from the member 50, as shown in FIG. 6. Spring 69 bearing against the detent mechanism 70 ensures that the detent end 68 is biased outwardly at all times. A suitable plug 72 encloses the mechanism 66 within the step bore 64 and sandwiches the spring 69 between the detent end 70 and the plug 72. It can thus be seen that in use the member 50 of the handle 18 is telescopically received within the end 14 of the intermediate section 12, wherein the inner surface 60 of the handle 18 forces the cord 20 (between the guide 36 and the handle 18) into the interior of the intermediate section 12, exerting an inward force against the guide 36 and causing it to move inwardly along the interior surface 38 of the intermediate section 12 until the guide 36 is moved to the position 39 indicated by the phantom lines in FIG. 4, at which time the inner end 74 of the handle cover 52 will abut the end 14 of the intermediate section 12, whereby the device 10 takes on the appearance as illustrated in FIG. 2 of the drawings. By properly rotating the handle member 18, the detent end 68 will become radially aligned with an aperture 76 strategically located near the anchor 22 in a proper position so as to secure the handle member 18 in the closed position illustrated in FIG. 2. Merely by manually pressing the detent 68 inwardly, the handle 18 may be withdrawn completely from the intermediate section 12 or, alternately, it may be moved until the detent 68 is radially aligned with a second aperture 78 (FIG. 4) located adjacent the end 14 of the intermediate section 12. The engagement of the detent 68 with the aperture 78 assures a secure locking of the handle 18 in the intermediate, extended position illustrated in FIG. 3 of the drawings. It should be noted that the apertures 76 and 78 are annularly spaced by 90° so that the user may withdraw the handle 18 completely from the intermediate section 12 without the accidental engagement of the detent 68 with the aperture 78.

When the handle 18 is in the intermediate section illustrated in FIG. 3 of the drawings and it is desired to withdraw the handle 18 from the intermediate section 12, the detent 68 is depressed and the handle 18 is fully extended and withdrawn from the interior of the intermediate section 12 and assumes the separated position shown in FIG. 1 of the drawings wherein a conventional nunchaku mode is obtained with the two elements, that is, the intermediate section 12 and the handle 18, being connected by the cord 20. It should be noted that the cord 20 extends from the center of both the intermediate section 12 and the handle 18, this being accomplished by the strategic location of the cord 20 on the surface 60 of the handle 18 and the unique and novel guide member 36.

It is obvious that a nunchaku device having just the right-hand portion of the intermediate section 12, that is, the portion to the right of the plane designated by the numeral 80, may be had whereby the intermediate section 12 will have a length which is approximately equal to the length of the handle 18.

It can thus be seen that applicant has provided a new and improved nunchaku device which is simple in its design and construction and, thus, inexpensive to manufacture. It can also be seen that the applicant has provided a new and unique, telescopically engaging nunchaku device which has several different modes of operation; and it should be understood by those skilled in the art of nunchaku devices that other forms of applicant's invention may be had, all coming within the spirit of the invention and scope of the accompanying claims.

What is claimed is as follows:

1. A nunchaku device comprising:

a first tubular handle having an opening at one end and an interior wall;

a second handle having one end telescopically received in said one end of said first tubular handle and movable from a first position wherein it is telescopically received by said first handle, to a second position wherein it is partially received by said first handle, to a third position wherein it is separated from said first handle;

a cord having one end attached to said interior wall of said first tubular handle and extending from said opening, said cord having another end attached to said one end of said second handle at the center thereof;

a guide member slidably mounted within said first tubular handle, said cord having an intermediate portion attached to and extending through the center of said guide member such that said guide member is movable with said cord within said first tubular handle, said cord being attached to said guide member a distance from said wall such that said guide member is extendable to said opening when said cord is extended and said second handle is in said third position so as to locate said cord at the center of said first handle opening;

detent means carried by said second handle; and a pair of longitudinally spaced aperatures disposed at selected, angularly offset locations along the longitudinal length of said first tubular handle such that said second handle's position along said first tubular handle may be lockingly secured at said selected locations, one of said apertures being positioned in said first tubular handle so as to be engaged by said detent means when said second handle is in said first position, the other of said apertures being positioned in said first tubular handle so as to be engaged by said detent means when said second handle is in said second position.

2. The nunchaku device as defined in claim 1 wherein:

said first tubular handle extends beyond said interior wall forming a third tubular handle with a second open end;

a fourth handle having one end telescopically received in said second end of said third tubular handle and movable from a first position wherein it is telescopically received by said third handle, to a second position wherein it is partially received by said third handle, to a third position wherein it is separated from said third handle;

a second cord having one end attached to said interior wall of said first tubular handle and extending from said second opening, said second cord having another end attached to said one end of said fourth handle at the center thereof;

a second guide member slidably mounted within said third tubular handle, said second cord having an intermediate portion attached to and extending through the center of said second guide member such that said second guide member is movable with said second cord within said third tubular handle, said second cord being attached to said second guide member a distance from said wall such that said second guide member is extendable to said second opening when said cord is extended and said fourth handle is in said third position so as to locate said second cord at the center of said third handle opening;

second detent means carried by said fourth handle; and a second pair of longitudinally spaced apertures disposed at selected locations along the longitudinal length of said first tubular means such that said fourth handle's position along said third tubular member may be lockingly secured at said selected locations, one of said second apertures being positioned in said third tubular handle so as to be engaged by said second detent means when said fourth handle is in said first position, the other of said second apertures being positioned in said third tubular handle so as to be engaged by said second detent means when said fourth tubular handle is in said second position.

* * * * *